US007108165B2

(12) United States Patent
Tsai

(10) Patent No.: US 7,108,165 B2
(45) Date of Patent: Sep. 19, 2006

(54) STAPLER CAPABLE OF CUTTING STAPLE LEGS ONE AFTER ANOTHER

(75) Inventor: Eric Tsai, Taichung Hsien (TW)

(73) Assignee: Apex Mfg. Co., Ltd., Tali (TW)

( * ) Notice: Subject to any disclaimer, the term of this patent is extended or adjusted under 35 U.S.C. 154(b) by 66 days.

(21) Appl. No.: 11/043,334

(22) Filed: Jan. 26, 2005

(65) Prior Publication Data

US 2006/0118593 A1 Jun. 8, 2006

Related U.S. Application Data

(63) Continuation-in-part of application No. 11/006,587, filed on Dec. 8, 2004, now Pat. No. 6,981,626.

(51) Int. Cl.
*B25C 7/00* (2006.01)

(52) U.S. Cl. ..... 227/155; 227/79

(58) Field of Classification Search ..... 227/79, 227/131, 120, 155, 76, 82
See application file for complete search history.

(56) References Cited

U.S. PATENT DOCUMENTS

| | | | | |
|---|---|---|---|---|
| 1,962,874 A | | 6/1934 | Polzer | |
| 3,034,382 A | * | 5/1962 | Hazel | 29/566 |
| 4,199,095 A | | 4/1980 | Yamanoi | 227/125 |
| 4,378,085 A | | 3/1983 | McVeigh | 227/79 |
| 4,593,847 A | * | 6/1986 | Hagemann | 227/155 |
| 4,844,319 A | | 7/1989 | Kurosawa | 227/79 |
| 5,029,745 A | * | 7/1991 | Akizawa et al. | 227/155 |
| 5,586,710 A | * | 12/1996 | Golicz | 227/155 |
| 5,639,007 A | | 6/1997 | Nakamura | 227/109 |
| 5,758,813 A | | 6/1998 | Kikuchi et al. | 227/155 |
| 5,791,543 A | | 8/1998 | Udagawa et al. | 227/4 |
| 6,036,074 A | | 3/2000 | Manabe | 227/155 |
| 6,250,531 B1 | | 6/2001 | Yagi | 227/79 |
| 6,776,321 B1 | | 8/2004 | Jairam et al. | 227/134 |
| 6,820,790 B1 | | 11/2004 | Ura | 227/131 |
| 6,981,626 B1 | * | 1/2006 | Tsai | 227/79 |
| 6,981,627 B1 | * | 1/2006 | Tsai | 227/155 |

FOREIGN PATENT DOCUMENTS

DE 44 34 513 C1 8/1995

OTHER PUBLICATIONS

PCT Patent Publication No. WO 03/057417 A1, Jul. 17, 2003.

* cited by examiner

*Primary Examiner*—Scott A. Smith
(74) *Attorney, Agent, or Firm*—Alan D. Kamrath; Nikolai & Mersereau, P.A.

(57) ABSTRACT

A stapler includes a base, a cover installed on the base, a feeding device for feeding staples, a connecting device for connecting the base, the cover and the feeding device with one another, and a bending and cutting device installed between the base and the cover for bending the legs of each staple and cutting the legs of each staple one at a time.

8 Claims, 10 Drawing Sheets

STAPLER CAPABLE OF CUTTING STAPLE LEGS ONE AFTER ANOTHER

CROSS REFERENCE TO RELATED APPLICATION

This is a continuation-in-part application of U.S. patent application Ser. No. 11/006,587 filed on Dec. 8, 2004, now U.S. Pat. No. 6,981,626.

BACKGROUND OF INVENTION

1. Field of Invention

The present invention relates to a stapler capable of cutting staple legs one after another.

2. Background of Invention

WO 03/057417 A1 discloses a STAPLER WITH BENDING ARMS WHICH CUT THE STAPLER LEGS AGAINST A PAD. The stapler includes two bending arms 40 and 41 and a cutter 49 (see FIGS. 9 and 10). The bending arm 40 is pivotally installed by means of a pin 42. The bending arm 40 includes a lever 45 on a side of the pin 42 and a bending surface 44 on the other side of the pin 42. The bending arm 41 is pivotally installed by means of a pin 43. The bending arm 41 includes a lever 48 on a side of the pin 43 and a bending surface 47 on the other side of the pin 43. The cutter 49 is located between the bending surfaces 44 and 47. As the levers 45 and 48 are pivoted, the bending surfaces 44 and 47 bend and press stapler legs 53 and 54 against two cutting edges of the cutter 49. Thus, the staple legs 53 and 54 are cut. It however requires a large force to cut the stapler legs 53 and 54 simultaneously. The present invention is therefore intended to obviate or at least alleviate the problems encountered in prior art.

SUMMARY OF INVENTION

According to the present invention, a stapler includes a base, a cover installed on the base, a feeding device for feeding staples, a connecting device for connecting the base, the cover and the feeding device with one another, and a bending and cutting device installed between the base and the cover for bending the legs of each staple and cutting the legs of each staple one at a time.

The primary advantage of the stapler according to the present invention is that it requires a user to exert a small force to cut the legs of each staple one at a time.

Other objects, advantages and novel features of the invention will become more apparent from the following detailed description in conjunction with the attached drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
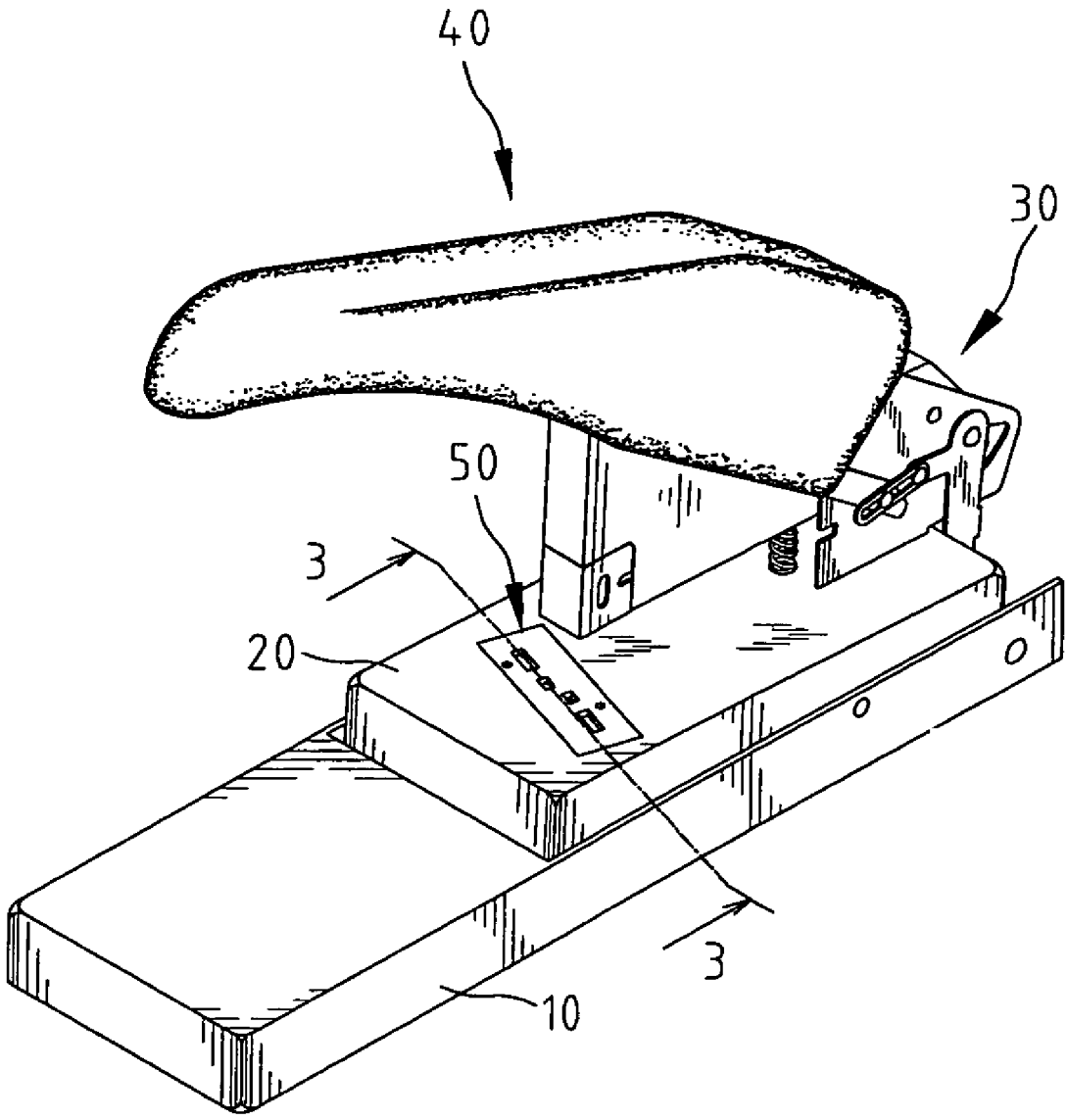
FIG. 1 is a perspective view of a stapler according to the preferred embodiment of the present invention.

Referring to FIG. 1, according to the preferred embodiment of the present invention, a stapler includes a base 10; a cover 20 installed on the base 10, a feeding device 40 for feeding staples 45 (FIG. 3), a connecting device 30 for connecting the base 10, the cover 20 and the feeding device 40 with one another and a bending and cutting device 50 for bending and cutting the legs 47 and 48 of the staples 45.

Figure 2:
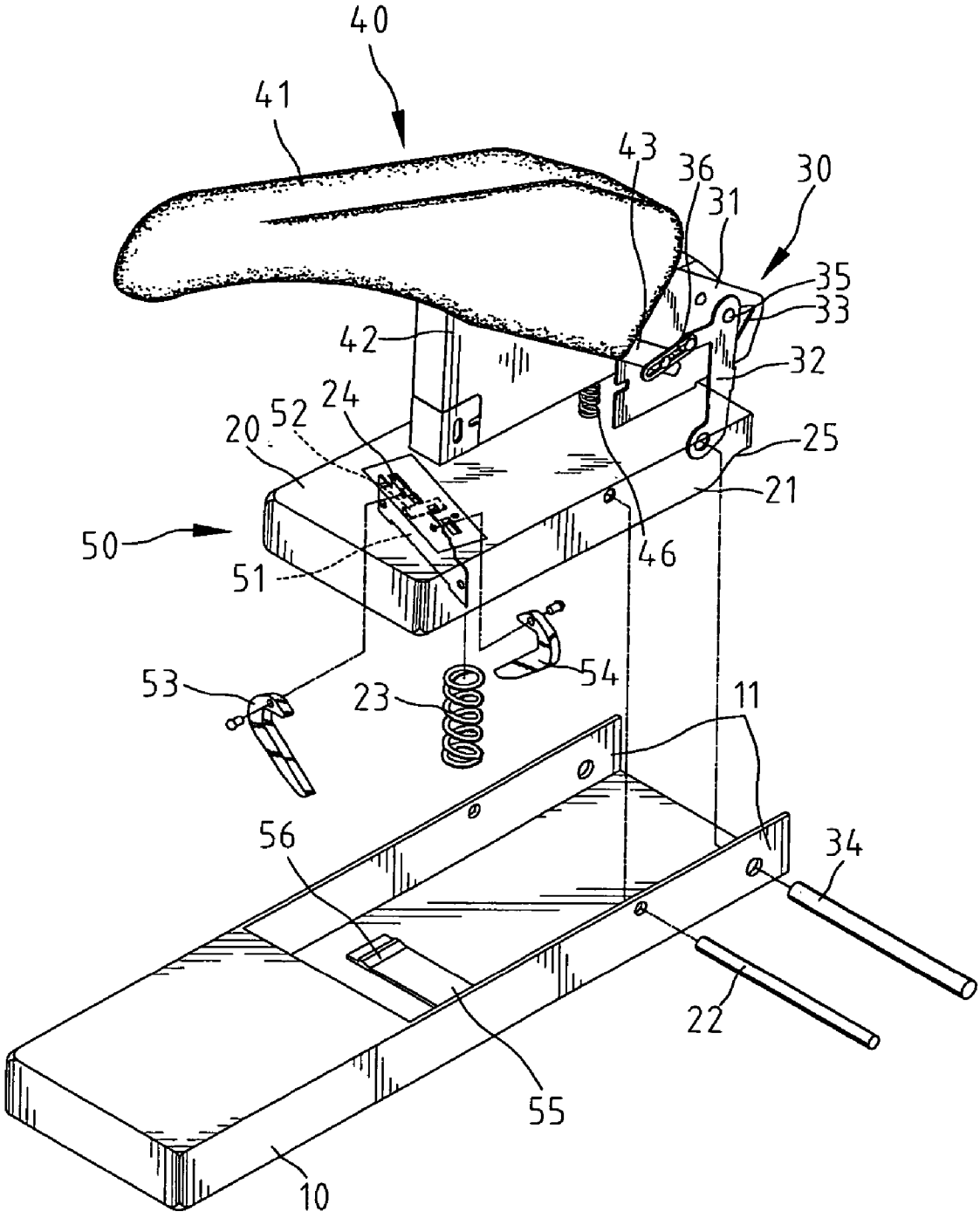
FIG. 2 is an exploded view of the stapler shown in FIG. 1.
Figure 3:
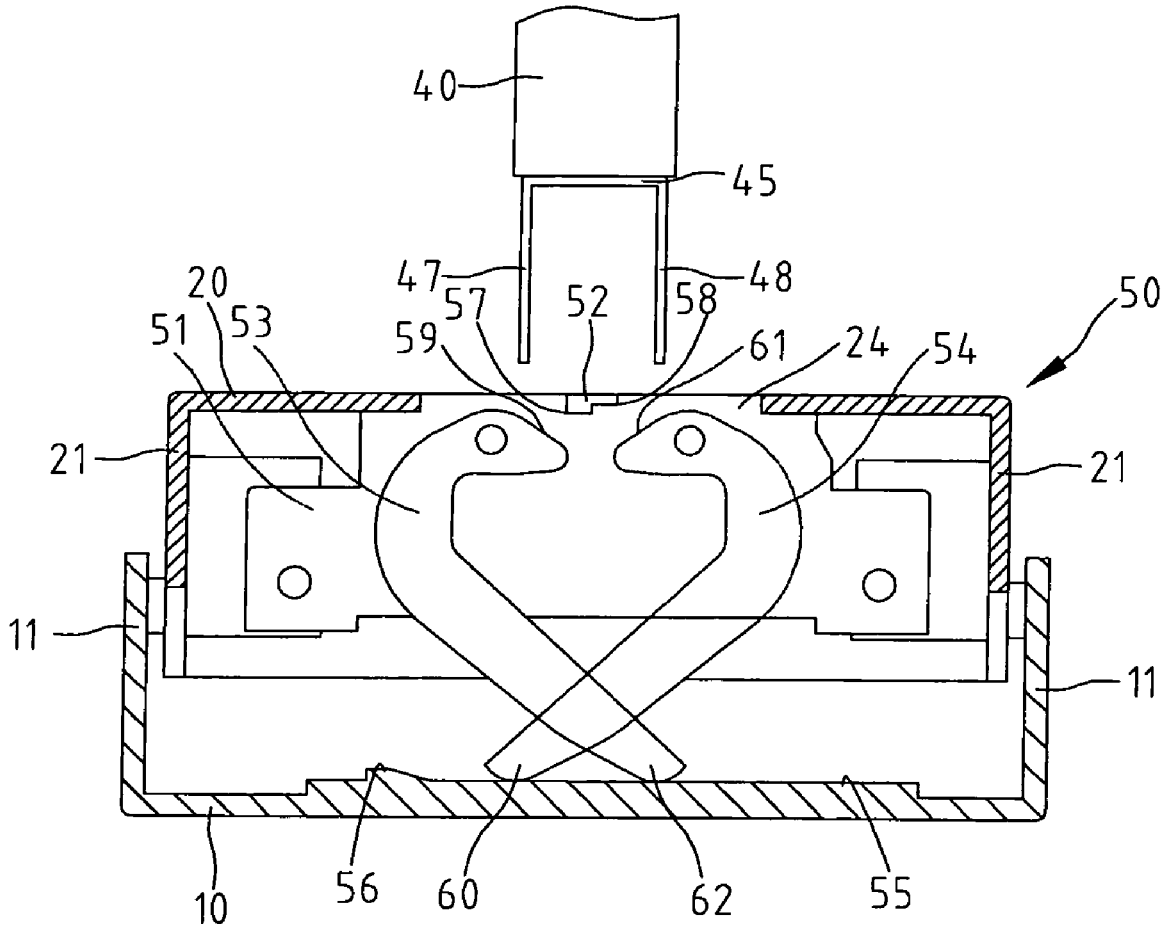
FIG. 3 is a cross-sectional view of the stapler shown in FIG. 1.

Referring to FIGS. 2 and 3, the base 10 includes two walls 11. The cover 20 includes two walls 21 connected with the walls 11 of the base 10 by means of a pin 22. Each wall 21 includes a cutout 25. A spring 23 is compressed between the cover 20 and the base 10. Two slots 24 are defined in the cover 20.

The feeding device 40 includes a cartridge 42 for storing the staples 45 and a lever 41 for moving the cartridge 42, driving the staples 45 from the cartridge 42 and moving the cover 20. Two extensions 43 extend from the lever 41.

The connecting device 30 includes two plates 31 and two linkages each including a first link 32 and a second link 36. The plates 31 are installed on the cover 20. A pin 34 is inserted in an aperture (not numbered) defined in a lower end of the first link 32 of each linkage through an aperture (not numbered) defined in each wall 11 of the base 10.

The cartridge 42 is located between and pivotally connected with the plates 31. A spring 46 is compressed between the cartridge 42 and the cover 20. Each plate 31 includes an inverted L-shaped slot 33. A pin 35 is inserted in the slot 33 of each plate 31 through an aperture (not shown) defined in an upper end of the first link 32 of each linkage. The second link 36 of each linkage is movably and pivotally connected between the first link 32 and a related extension 43.

The feeding device 40 and the connecting device 30 and their connection and cooperation with one another are substantially conventional and will not be described in detail.

The bending and cutting device 50 includes a cutting element 52 attached to a lower surface of the cover 20, a plate 51 extending from the lower surface of the cover 20, a first bending element 53 pivotally connected with the plate 51, a second bending element 54 pivotally connected with the plate 51, a pad 55 attached to the base 10 and a wedge 56 formed on the pad 55. The cutting element 52 includes a first cutting portion 57 and a second cutting portion 58 thinner than the first cutting portion 57. The first cutting portion 57 includes a cutting edge (not numbered). The second cutting portion 58 includes a cutting edge (not numbered). The first bending element 53 includes an upper end 59 for bending and pressing each staple 45 against the first cutting portion 57 and a lower end 60 for pressing against and sliding on the pad 55. The second bending element 54 includes an upper end 61 for bending and pressing each staple 45 against the second cutting portion 58 and a lower end 62 for pressing against and sliding on the pad 55 and the wedge 56.

Figure 4:
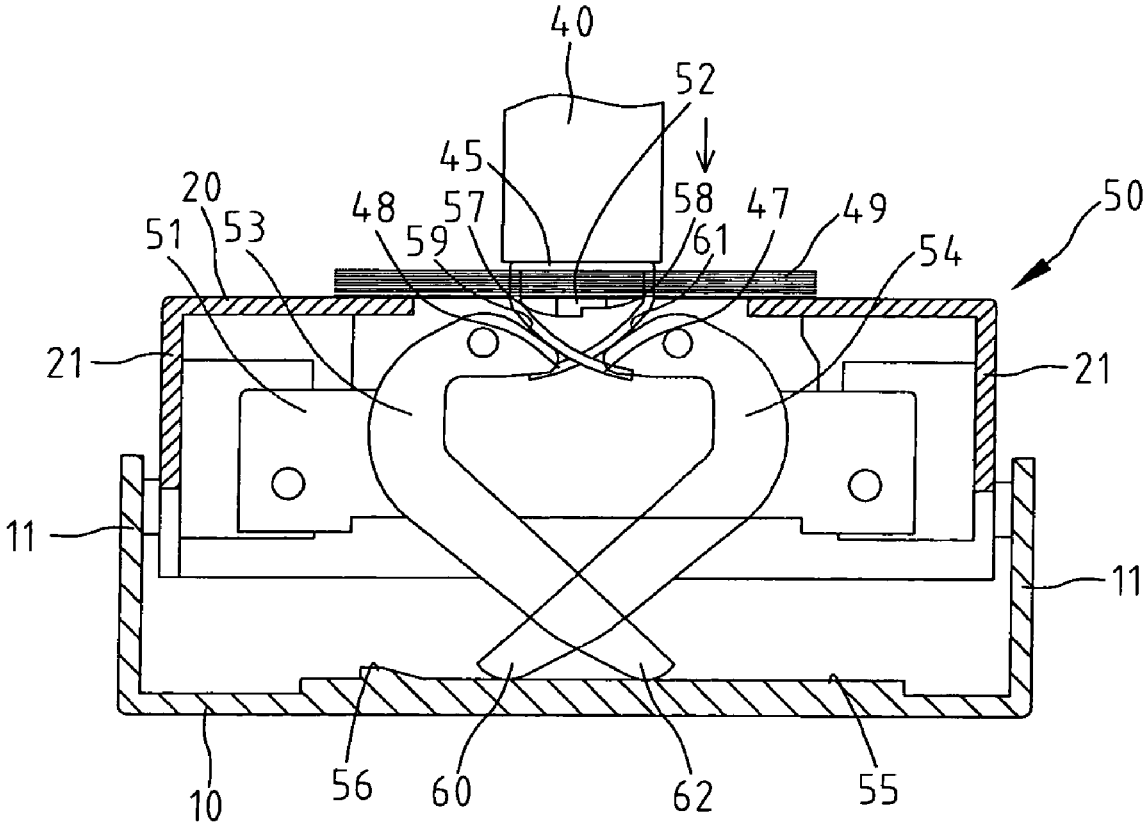
FIG. 4 shows first and second staple legs bent by means of the stapler shown in FIG. 3.

Referring to FIG. 4, a staple 45 is driven from the cartridge 42. A first leg 47 and a second leg 48 of the staple 45 are inserted through a stack 49 of paper. The first leg 47 is bent by means of the first bending arm 53 as the later is pivoted. The second leg 48 is bent by means of the second bending arm 54 as the later is pivoted.

Figure 5:
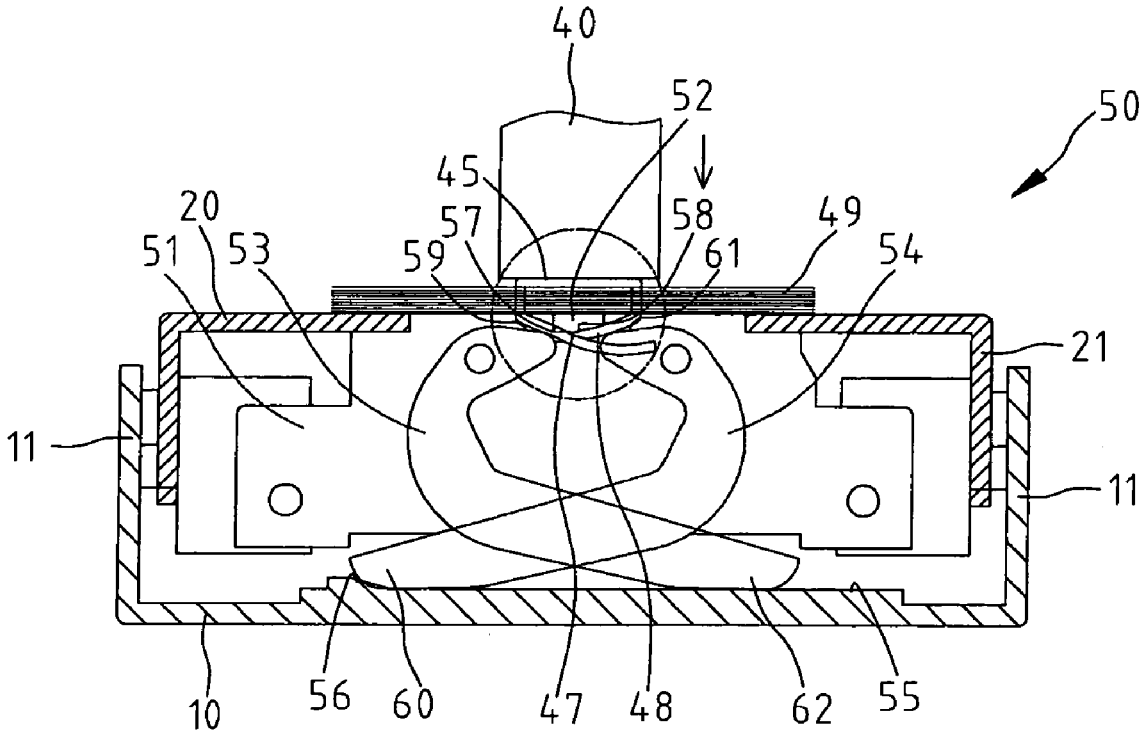
FIG. 5 shows the first staple leg about to be cut by means of the stapler shown in FIG. 4.
Figure 6:
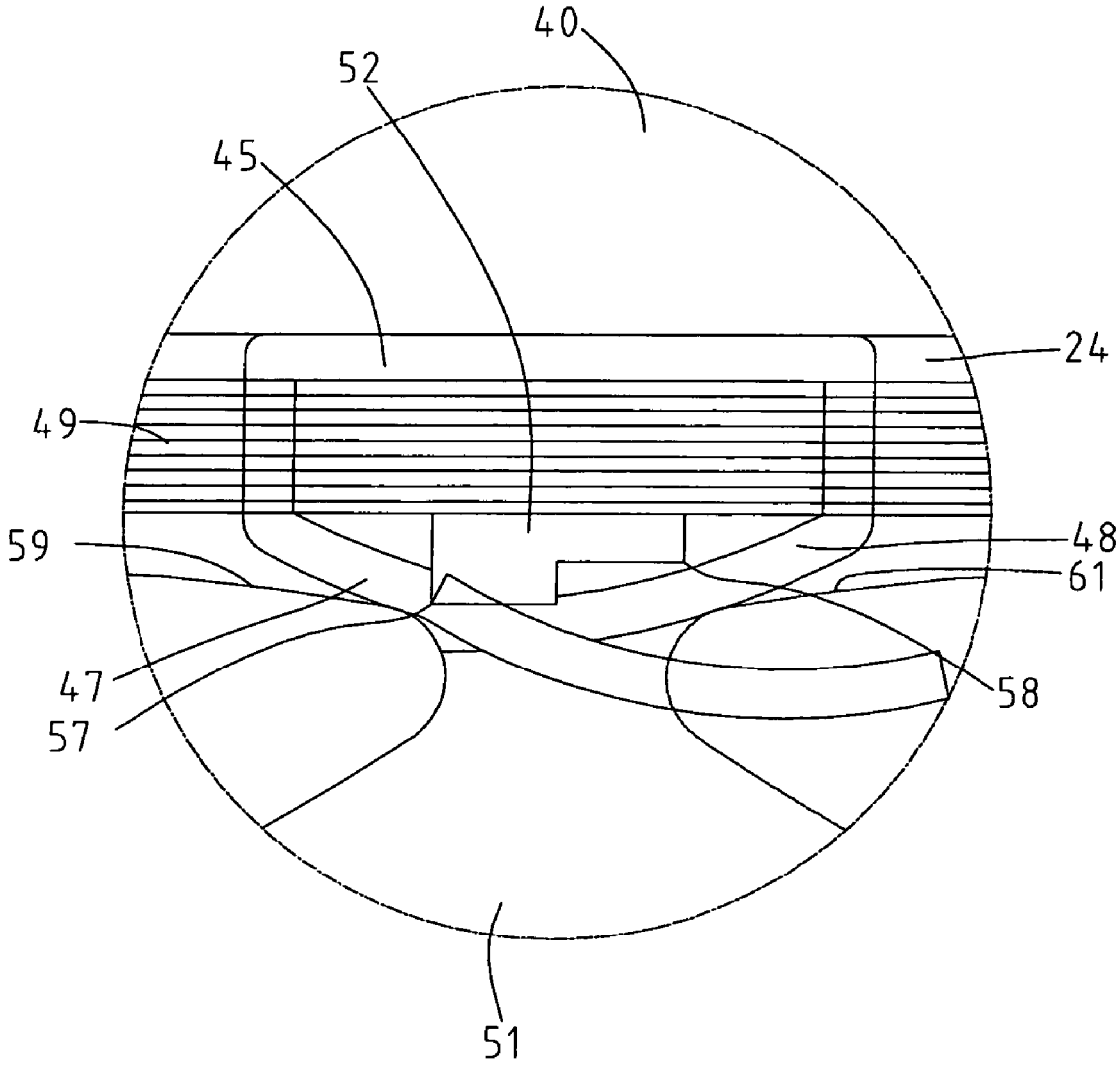
FIG. 6 shows the first staple leg being cut by means of the stapler shown in FIG. 5.
Figure 7:
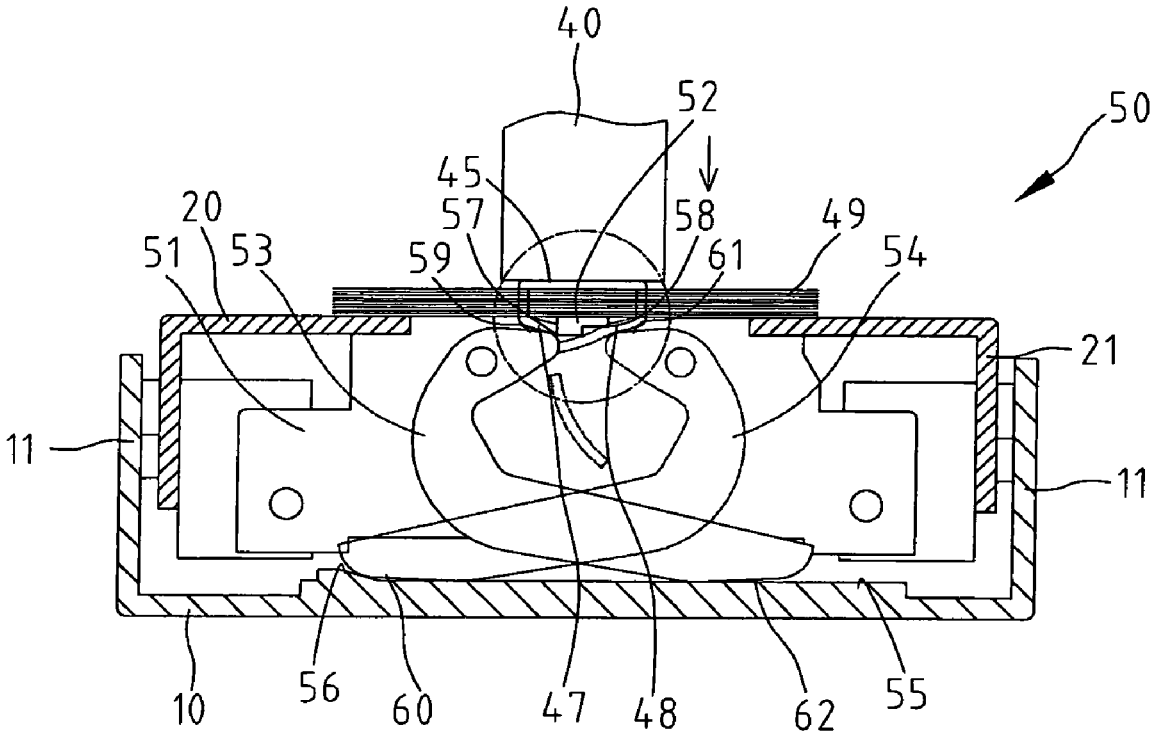
FIG. 7 shows the first staple leg cut and the second staple leg about to be cut by means of the stapler shown in FIG. 6.

Referring to FIG. 5, the first leg 47 is pressed against the first cutting portion 57 by means of the first bending arm 53 before the second leg 48 is pressed against the second cutting portion 58 by means of the second bending arm 54. Referring to FIGS. 6 and 7, the first leg 47 is cut by the first cutting portion 57 before the second leg 48 is pressed against the second cutting portion 58 by means of the second bending arm 54.

Figure 8:
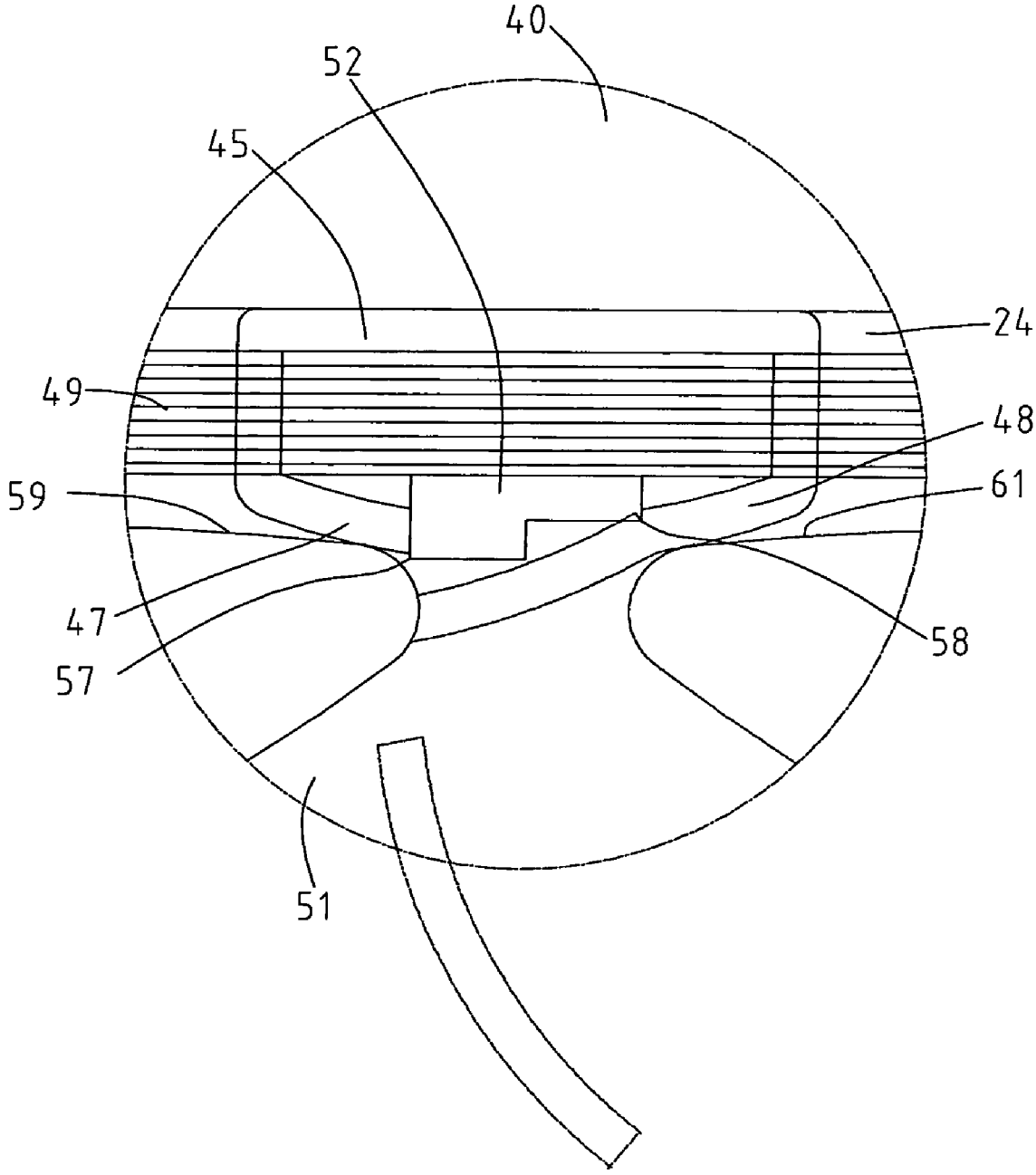
FIG. 8 shows the second staple leg being cut by means of the stapler shown in FIG. 7.
Figure 9:
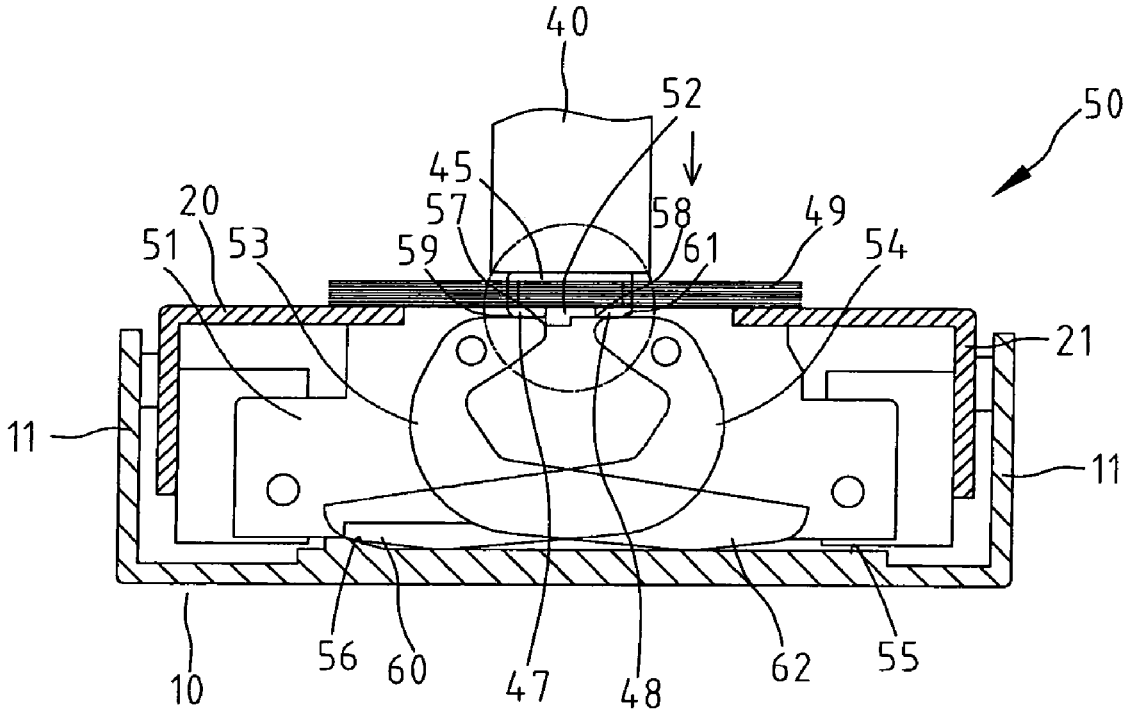
FIG. 9 shows the first and second staple legs cut and bent by means of the stapler shown in FIG. 8.
Figure 10:
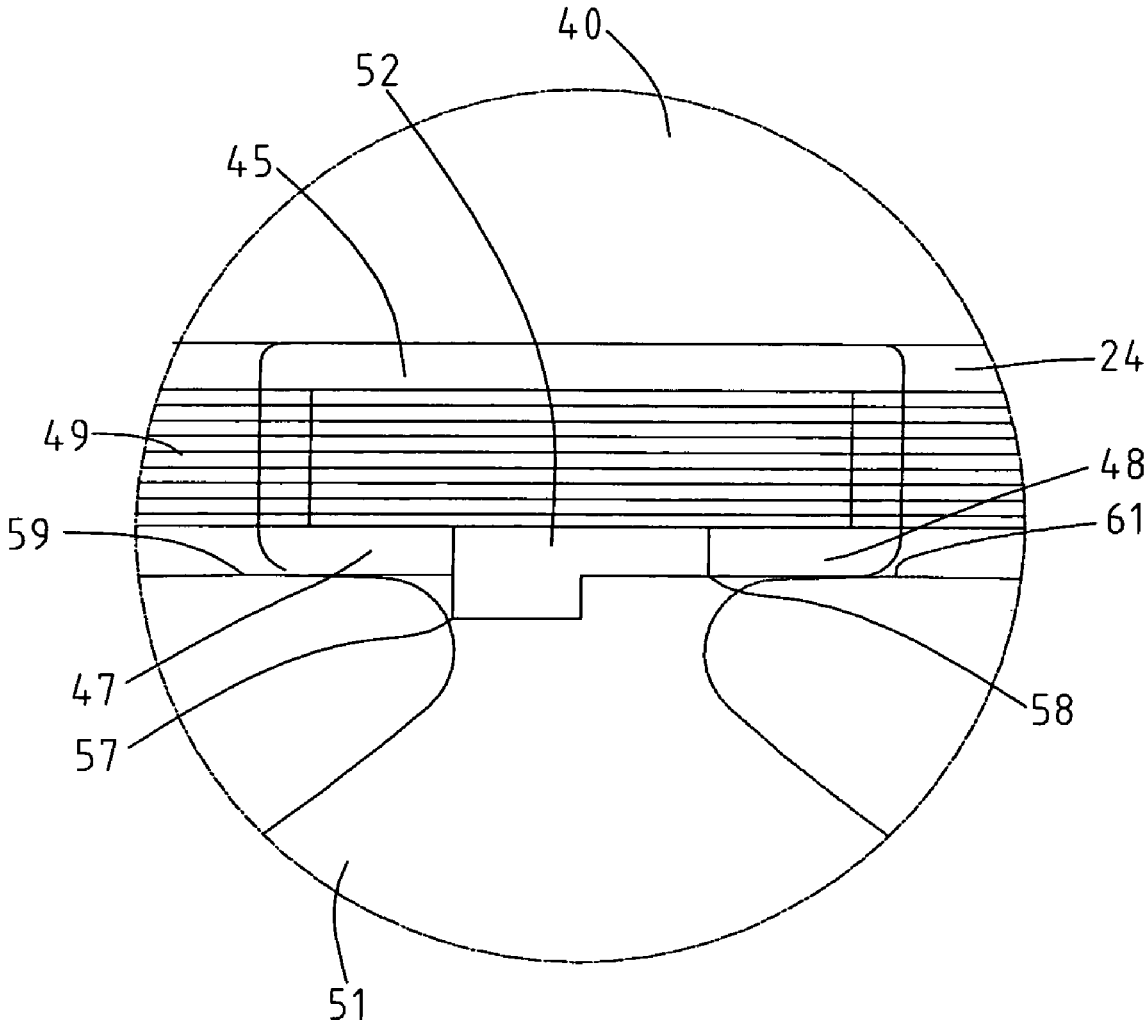
FIG. 10 is an enlarged partial view of the stapler shown in FIG. 9.

Referring to FIG. 8, only after the first leg 47 is cut by the first cutting portion 57, the second leg 48 is pressed against the second cutting portion 58 by means of the second bending arm 54. Referring to FIG. 9, the lower end 62 of the second bending element 54 is pressed against and caused to slide on the wedge 56 in order to press the second leg 48 hard against the second cutting portion 58. Referring to FIG. 10, the second leg 48 is cut by the second cutting portion 58.

From the fore-going description referring to FIGS. 5 through 10, it is learned that the legs 47 and 48 are cut, one at a time. Thus, the stapler according to the present invention requires a smaller force in operation than the conventional stapler discussed in the Related Prior Art.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A stapler comprising a base, a cover installed on the base, a feeding device for feeding staples, a connecting device for connecting the base, the cover and the feeding device with one another, and a bending and cutting device installed between the base and the cover for bending the legs of each staple and cutting the legs one at a time.

2. The stapler according to claim 1 wherein the bending and cutting device comprises a cutting element secured to the cover and formed with a first cutting portion and a second cutting portion so that the first cutting portion cuts the first leg of each staple before the second cutting portion cuts the second leg of each staple.

3. The stapler according to claim 2 wherein the first cutting portion is thicker than the first cutting portion.

4. The stapler according to claim 2 wherein the bending device comprise a first bending element pivotally connected with the cover for bending the first leg of each staple and a second bending element pivotally connected with the cover for bending the second leg of each staple.

5. The stapler according to claim 4 wherein the bending and cutting device comprises a plate extending from the cover for supporting the first and second bending elements.

6. The stapler according to claim 4 wherein the bending and cutting device comprises a wedge attached to the base for pressing hard against the second bending element.

7. The stapler according to claim 4 wherein the bending and cutting device comprises a pad attached to the base for contact with the first and second bending elements.

8. The stapler according to claim 7 wherein the bending and cutting device comprises a wedge attached to the pad for pressing hard against the second bending element.

* * * * *